US005682979A

United States Patent [19]

Krueger et al.

[11] Patent Number: 5,682,979

[45] Date of Patent: Nov. 4, 1997

[54] SWITCHING ASSEMBLY FOR GAS BURNER VALVE

[75] Inventors: Donald M. Krueger, Westchester; Robert F. Puchalski, Carol Stream, both of Ill.

[73] Assignee: Eaton Corporation, Cleveland, Ohio

[21] Appl. No.: 449,857

[22] Filed: May 24, 1995

Related U.S. Application Data

[63] Continuation of Ser. No. 411,099, Mar. 27, 1995, abandoned.

[51] Int. Cl.[6] ..... H01H 1/40

[52] U.S. Cl. ..... 200/571

[58] Field of Search ..... 200/570, 571, 200/567

[56] References Cited

U.S. PATENT DOCUMENTS 3,748,419 7/1973 Torrey et al. ..... 200/570
3,983,354 9/1976 Gamie et al. ..... 200/571 X
4,218,594 8/1980 Komatsu et al. ..... 200/570 X
4,626,637 12/1986 Ollson et al. ..... 200/571 X

FOREIGN PATENT DOCUMENTS 2241381 8/1991 United Kingdom ..... 200/567

*Primary Examiner*—Renee S. Luebke
*Attorney, Agent, or Firm*—Roger A. Johnston

[57] ABSTRACT

A rotary switch assembly for use with a fuel burner valve having a user rotatable shaft. The switch has an annular sleeve which upon being received over the valve shaft is engaged to be rotated by the valve shaft. The rotor has a conductive contact ring frictionally engaging the rotor with inward projections on the ring frictionally engaging torque transmitting grooves formed on the rotor. The rotor is journalled on the switch base which has stationary contacts provided on opposite sides of the rotor. User rotation of the valve shaft causes the rotor to rotate and the wiper contacts complete a circuit between the stationary contacts.

7 Claims, 2 Drawing Sheets

SWITCHING ASSEMBLY FOR GAS BURNER VALVE

This application is a Continuation of co-pending application Ser. No. 08/411,099, Filed On Mar. 27, 1995 entitled 'SWITCHING ASSEMBLY FOR GAS BURNER VALVE' in the name of Donald M. Krueger now abandoned.

BACKGROUND OF THE INVENTION

The present invention relates to switches of the type associated with burner control valves employed on gaseous fuel burners utilized in cooking appliances and particularly rangetop burners. Typically, rangetop burners are supplied from a fuel gas manifold with individual user operated control valves provided for selecting the desired burner to be operated for cooking. In the more common cooking range constructions, the top burner manifold extends along the front of the rangetop cabinet with the individual burner valves mounted spaced therealong. Typically each burner valve has an operating shaft extending through the cabinet and the shaft is provided with a control knob for enabling the user to turn the burner valve on and off and to adjust the flow through the valve to produce the desired amount of flame at the burner. Thus, in the manufacture and assembly of the range, it is required to have a switch provided for each of the top burner valves and the attendant wiring associated therewith for connection to the ignitor circuitry. In such rangetop burner applications, it is commonplace to have a rotary cam provided on the burner valve shaft such that the cam is operative to close a switch upon rotation of the valve from the "OFF" position to a position for ignition. In such known switch arrangements the switch is operative to complete a circuit to energize a spark ignitor for the burner.

Heretofore, it has been the practice in typical gas burner valve switches to provide a cam member through which the rotary valve shaft is received and engaged; and, the cam member actuates a moveable contact blade for making and breaking a set of contacts disposed within the switch housing. This arrangement has required precision location of angular orientation of the cam with respect to the moveable switch contact blade mounted on the housing for providing the proper closing of the switch contacts with respect to the angular position of the cam and burner valve shaft. The aforesaid type of cam operated switch has been particularly susceptible to corrosion and deposits of foreign matter on the switch contacts.

Known gas burner valve switches employed in the typical household cooking rangetop are susceptible to flooding with liquefied foodstuffs from boil-overs and spillage. This flooding of the switches has caused leakage of the liquefied matter into the switch and has caused corrosion and resulted in failure of the switch contacts in service. Therefore, it has been desired to provide an improved gas burner valve switch which is resistant to liquefied matter and corrosion and which is low in manufacturing cost and easy to install on a burner valve during assembly of the range.

SUMMARY OF THE INVENTION

The present invention provides a rotary switch received over the shaft of a rotary gas burner fuel valve, which is easy to install and is automatically oriented correctly on the shaft and is easy to connect in the ignitor circuit.

It is an object of the present invention to provide a rotary switch for a gas burner valve with an annular contactor member rotatable by the valve shaft for making and breaking a circuit with stationary contacts disposed on the switch housing.

It is a further object of the present invention to provide a rotary switch received over the valve shaft of a gas burner valve with an annular contactor ring frictionally engaging a sleeve member in torque transmitting engagement.

It is another object of the present invention to provide a rotary switch for installation over the shaft of a gas burner valve having a sleeve or annular member drivingly engaged by the burner valve shaft with a one piece wiper contact ring frictionally engaging the sleeve for rotation therewith and effecting switching with stationary contacts disposed on the switch housing.

DETAILED DESCRIPTION

Figure 2:
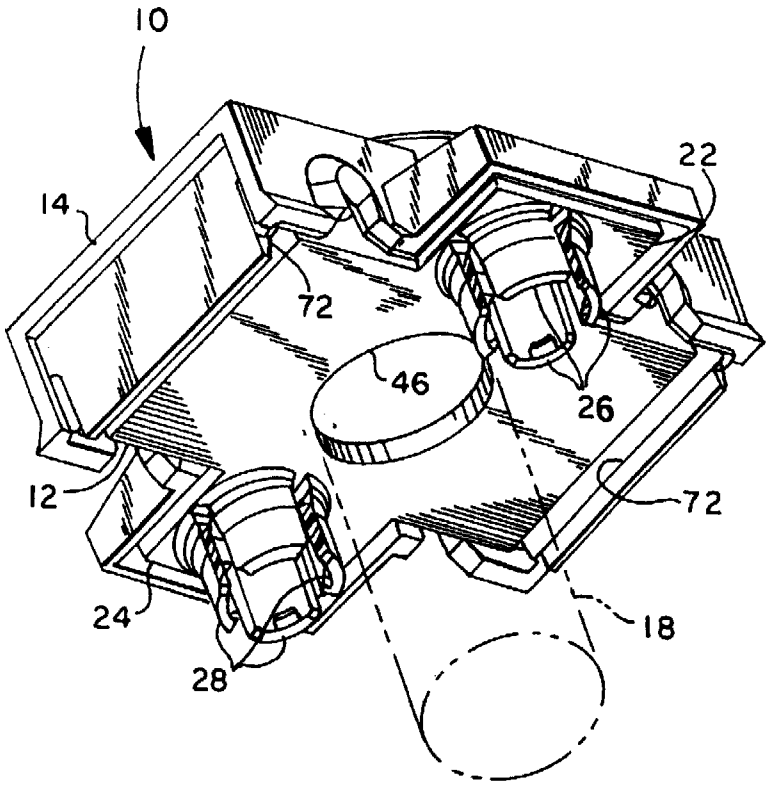
FIG. 2 is a perspective view of the switch assembly of FIG. 1 from the backside; and, FIG. 3 is an exploded view of the switch assembly of FIG. 1
Figure 1:
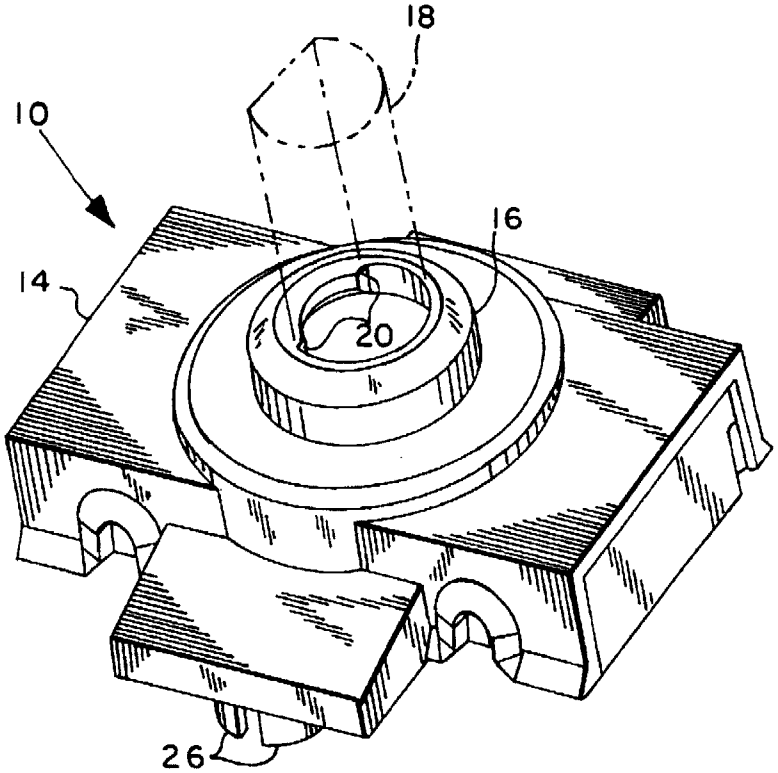
FIG. 1 is a perspective view of the switch assembly of the present invention from the front.

Referring to FIGS. 1 and 2, the switch assembly is indicated generally at 10 and has a housing means comprising a base 12 having a cover 14 received thereover with a rotor member 16 comprising an annular sleeve with one end preferably journalled for rotation in the cover 14 and an opposite end journalled in the base 12. However, it will be understood that the rotor may be journalled on base 12 and a clearance aperture provided in the cover 14. In the presently preferred practice the base 12, cover 14 and rotor 16 are formed of molded plastic material. The rotor or annular sleeve 16 is adapted to have the control shaft of a gas burner valve indicated in dashed outline and denoted by reference numeral 18 received therethrough and in rotary driving engagement therewith as for example by contact of a flattened portion with a pair of shoulders 20 formed in the rotor 16.

Figure 3:
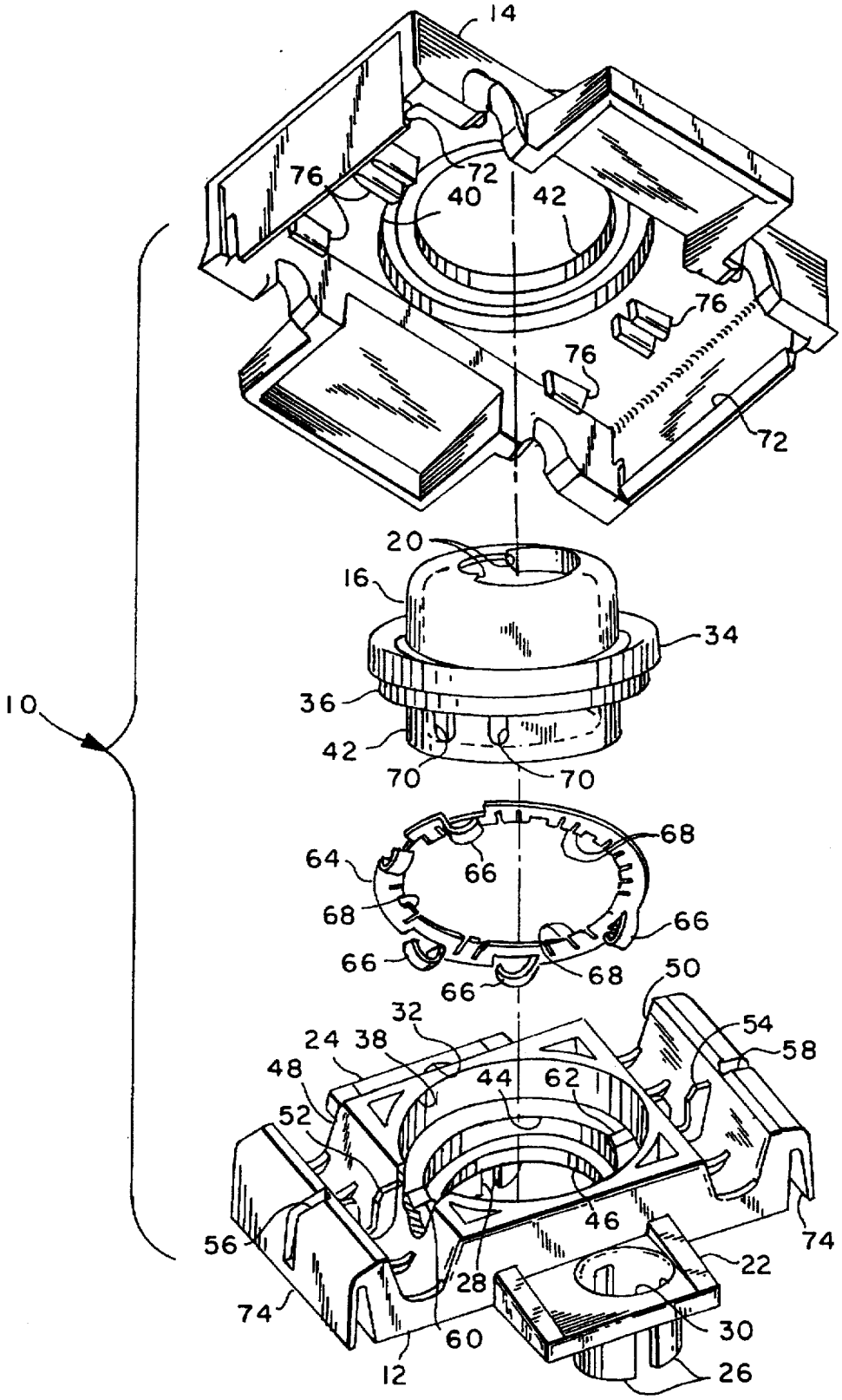

Referring to FIGS. 2 and 3, the base 12 has a pair of projections 22,24 disposed on opposite sides of the rotor which have locating tabs respectively 26, 28 depending therefrom and which surround mounting apertures 30, 32. Rotor 16 has a radially outwardly extending flange 34 which has a reduced diameter shoulder portion 36 provided thereon which is journalled in bore 38 formed in the base. Similarly a bore 40 is formed in the under surface of cover 14 for journalling of the upper portion of the rotor flange 34 therein. It will be understood that the lower end of the rotor 16 denoted by reference numeral 42 extends downwardly into a reduced diameter bore 44 provided in the base. If desired, the reduced diameter portion 42 may be journalled in the bore 44 and the bore 38 provided as a clearance for the flange 34. It will also be understood that the upper end of the rotor 16 may be journalled through an aperture 46 provided in the cover; and, the bore 44 may be formed as a clearance bore for rotor flange 34.

The base 12 has a pair of spaced parallel grooves 48,50 disposed on opposite sides of the bore 38; and, each of the grooves has a slotted, insulation deforming, electrically conductive terminal denoted respectively 52, 54 disposed therein and extending into respective slots 56, 58; and, each of the terminals 52, 54 extends through slots formed in the adjacent inboard portion of the base 12 to form a stationary contact terminal in the bottom of bore 38 as denoted by reference numerals 60, 62.

It will be understood that the slotted terminals 52, 54 are adapted to have an insulated electrical lead pressed therein for displacing insulation thereon and making electrical contact with the conductor therethrough such that the electrical leads (not shown) may be continuous and uninterrupted through the switch.

Referring to FIG. 3, an annular contact member in the form of relatively flat ring 64 of sheet metal stock has a plurality of circumferentially spaced wiper contacts formed integrally thereon and extending axially downwardly therefrom as denoted by reference numerals 66. It will be understood that the wipers 66 are disposed about the ring 64 such that when the ring is rotated to a desired position a pair of the wipers 66 make contact respectively with the terminals 60, 62 for completing a circuit therebetween.

The inner periphery of the ring 64 has a plurality of slots or cutouts formed therein in circumferentially spaced radially extending arrangement so as to form therebetween a plurality of tabs or radially inwardly extending prongs denoted by reference numeral 68 which are axially resiliently deformable.

A plurality of axially extending recesses are provided on the outer periphery of the lower portion 42 of the rotor 16 as denoted by reference numerals 70 which recesses are peripherally located to correspond with the prongs 68 such that upon axial assembly of the ring 64 over the lower portion 42 of the rotor 16, the tabs or prongs 68 are deformed and snapped into the recesses 70 to retain the ring on the rotor 16 and to provide for torque transmission between the rotor 16 and the ring 64 and to prevent incorrect assembly.

It will be understood that the cover 14 is assembled over the subassembly comprising the base 12 and rotor 16 with ring 64 pressed thereon. The cover 14 may be retained on the base by any suitable expedient such, as for example, snap locking of the barbs 72 provided on the sides of the cover over the lower edge portion 74 of the base. If desired, tabs or projections denoted by reference numeral 76 may be provided on the undersurface of the cover 14 for holding the electrical lead (not shown) in the conductor grooves 48, 50.

The present invention thus provides a simple and reliable rotary switch assembly for use with a gas burner valve and one which is low in manufacturing costs and easy to assemble. The switch of the present invention provides an annular contact ring frictionally assembled over a rotor or sleeve and engaged thereon to be rotated by the sleeve upon assembly of the rotor over a gas burner valve shaft.

Although the invention has hereinabove been described with respect to the illustrated embodiments, it will be understood that the invention is capable of modification and variation and is limited only by the following claims.

We claim:

1. A rotary switch for use with a gas burner valve having a user rotated shaft comprising:

(a) housing means including a base having a plurality of stationary contacts and connector terminals for external electrical connection thereto and a cover attached to the base;

(b) an annular sleeve member formed of insulator material having a plurality of torque transmitting surfaces disposed about the periphery thereof in spaced relationship said annular sleeve having an end journalled on said base and an end journalled on said cover;

(c) an annular contactor formed of electrically conductive material and having integrally formed thereon a plurality of first portions thereof defining wiper contacts for completing and breaking a circuit with said stationary contacts and a second portion thereof including certain cooperative surfaces engaging said torque transmitting surfaces for driving connection between said annular member and said contactor; and, (d) said annular sleeve member is adapted for being received over the valve shaft and engaged to be rotated thereby.

2. The assembly defined in claim 1, wherein said contactor certain cooperating surfaces comprise radially inwardly extending tabs formed about the inner periphery of said annular contactor.

3. The assembly defined in claim 1, wherein said contactor first portions comprise a plurality of tabs extending in a generally axial direction.

4. The assembly defined in claim 1, wherein said torque transmitting surfaces comprise recesses formed in the outer periphery of said annular sleeve member.

5. The assembly defined in claim 1, wherein said sleeve member and said housing means are formed of plastic material; and, said contactor is integrally formed from sheet metal stock.

6. The assembly defined in claim 1, wherein said wiper contacts have a generally "J"-shaped configuration.

7. The assembly defined in claim 1, wherein said housing means comprises a base and cover; and, said connector terminals include an insulation displacing terminal on said base adapted for receiving a continuous conductor therethrough with said cover received thereover.

* * * * *